US012678666B2

(12) United States Patent
Shiue

(10) Patent No.: US 12,678,666 B2
(45) Date of Patent: Jul. 14, 2026

(54) MASK AND TRANSPARENT VIEWING WINDOW MODULE THEREOF

(71) Applicant: QBAS Co., Ltd., Taipei City (TW)

(72) Inventor: Heng-Ea Shiue, Taipei City (TW)

(73) Assignee: QBAS CO., LTD., Taipei City (TW)

( * ) Notice: Subject to any disclaimer, the term of this patent is extended or adjusted under 35 U.S.C. 154(b) by 0 days.

(21) Appl. No.: 19/070,925

(22) Filed: Mar. 5, 2025

(65) Prior Publication Data

US 2025/0281800 A1 Sep. 11, 2025

Related U.S. Application Data

(60) Provisional application No. 63/561,902, filed on Mar. 6, 2024.

(51) Int. Cl.
*A63B 33/00* (2006.01)

(52) U.S. Cl.
CPC ..... *A63B 33/002* (2013.01)

(58) Field of Classification Search
CPC ..... A63B 33/002; A63B 33/004; B63C 11/12; A61F 9/02; A61F 2009/021; A61F 9/022; A61F 9/025; A61F 9/026; A61F 9/029; A61F 9/023; G02C 7/02; G02C 7/022; G02C 7/10; G02B 1/10; G02B 1/11; G02B 1/14; G02B 1/18; G02B 3/0068; C03C 17/00; C03C 17/001; C03C 17/002; C03C 17/006; A42B 3/22; A42B 3/225; A42B 3/226; A42B 3/227; A42B 3/24
USPC ..... 2/435, 436, 432, 434
See application file for complete search history.

(56) References Cited

U.S. PATENT DOCUMENTS 1,562,350 A * 11/1925 Luckey ..... G02C 11/08 128/201.15
3,259,909 A * 7/1966 Wood ..... A61F 9/025 2/440
4,648,394 A * 3/1987 Wise ..... A62B 18/082 351/154
5,140,710 A * 8/1992 Rademacher ..... A61F 9/022 351/44
5,642,530 A * 7/1997 Parks ..... A42B 3/24 2/435
8,469,509 B2 * 6/2013 Yang ..... A61F 9/025 2/435
2002/0191148 A1 * 12/2002 Sheldon ..... B63C 11/12 351/62

(Continued)

FOREIGN PATENT DOCUMENTS

FR 2722890 A1 * 1/1996 ..... G02C 11/02
JP 2011130833 A * 7/2011

(Continued)

*Primary Examiner* — Clinton T Ostrup
(74) *Attorney, Agent, or Firm* — MUNCY, GEISSLER, OLDS & LOWE, P.C.

(57) ABSTRACT

A mask and a transparent viewing window module thereof are provided. The transparent viewing window module includes a glass viewing window and an integrally-formed transparent encapsulation layer. The glass viewing window has an inner surface, an outer surface opposite to the inner surface and a peripheral portion defined along an outer contour of the glass viewing window. The integrally-formed transparent encapsulation layer fully and tightly encompasses the peripheral portion and the inner surface of the glass viewing window.

19 Claims, 12 Drawing Sheets

(56) References Cited

U.S. PATENT DOCUMENTS

| | | | | |
|---|---|---|---|---|
| 2006/0045964 | A1* | 3/2006 | Wu | G02B 27/0006 427/162 |
| 2012/0137398 | A1* | 6/2012 | Arnold | A61F 9/025 2/431 |
| 2018/0162771 | A1* | 6/2018 | Fujii | C03C 3/085 |
| 2018/0275484 | A1* | 9/2018 | Wada | G02F 1/31 |
| 2019/0358496 | A1* | 11/2019 | Shiue | A63B 33/002 |
| 2020/0317562 | A1* | 10/2020 | Lee | C03C 23/007 |
| 2021/0219648 | A1* | 7/2021 | Jongsma | A42B 3/225 |
| 2022/0410511 | A1* | 12/2022 | Ambur | B29D 11/0048 |
| 2024/0081132 | A1* | 3/2024 | Ye | G02B 1/14 |
| 2025/0074560 | A1* | 3/2025 | Shiue | B63C 11/16 |

FOREIGN PATENT DOCUMENTS

| | | | | |
|---|---|---|---|---|
| KR | 200280609 | Y1 * | 7/2002 | |
| KR | 102061310 | B1 * | 12/2019 | B32B 7/12 |
| KR | 102613343 | B1 * | 12/2023 | C03C 17/002 |
| TW | 201804172 | A | 2/2018 | |
| TW | 202032192 | A | 9/2020 | |

* cited by examiner

MASK AND TRANSPARENT VIEWING WINDOW MODULE THEREOF

CROSS-REFERENCES TO RELATED APPLICATIONS

This patent application claims the benefit of U.S. Prov. Ser. No. 63/561,902 filed on Mar. 6, 2024, which is incorporated in its entirety by reference.

BACKGROUND OF THE INVENTION

Field of the Invention

The present invention relates to a mask, especially a mask used, for example, for swimming, snorkeling, free diving, spearfishing or other water activities (including both surface and underwater activities).

Descriptions of the Related Art

Water activities (such as swimming, snorkeling, free diving or spearfishing) are one of the most popular leisure activities in modern times. During water activities, users often wear a mask to protect their eyes and ensure a clear field of vision.

Most masks that cover the user's eyes and nose are mainly composed of glass viewing window(s) and a waterproof skirt. They can generally be divided into a single-viewing window type and a dual-viewing windows type. The waterproof skirt may be made of soft materials such as silicone rubber and thermoplastic rubber (TPR). As shown in FIGS. 1A to 1C, in the single-viewing window mask 1, a waterproof skirt 11 may be directly injection-molded onto the glass viewing window 13 without a frame. In this case, the front portion of the waterproof skirt 11 encapsulates the peripheral portion of the glass viewing window 13, and the rear portion of the waterproof skirt 11 is adapted to fit the user's face.

In addition, as shown in FIGS. 2A to 2D, the dual-viewing windows mask 2 contains two separate glass viewing windows. Therefore, in general, a rigid material such as polycarbonate (PC) or nylon serving as the inner frame 25 is used to, through an injection-molding, encapsulate the peripheral portions of the two separate glass viewing windows 23R and 23L, respectively. Meanwhile, the two glass viewing windows 23R and 23L are bridged to each other through the inner frame 25 to sustain their relative positions, thereby ensuring structural rigidity and stability in use, as shown in FIG. 2B. Then, the glass viewing windows 23R and 23L with their peripheral portions encapsulated by the inner frame 25 through an injection-molding are further wrapped by the front portion of the waterproof skirt 21 to form the structure of the dual-viewing windows mask 2.

However, regardless of single-viewing window mask or a dual-viewing windows mask, the position that the waterproof skirt and/or the inner frame to couple with the glass viewing window(s) is only limited to the peripheral portion (s) thereof. Therefore, when the glass viewing window breaks (e.g., due to pressure or temperature changes, or external force impact), the glass fragments can easily cause injury to the user, with potential for serious eye damage. Furthermore, to meet the needs of myopic users, the chosen prescription glass viewing window is inevitably thick and heavy. Consequently, additional supporting measures, such as increasing the thickness of the waterproof skirt and/or expanding the area encapsulating the glass viewing window, are required to ensure the overall structural stability of the mask.

In addition, because glass cannot provide anti-fog capabilities due to its material properties, the glass viewing window usually needs to be sprayed with anti-fog agents afterwards. However, because these anti-fog agents are not durable in effectiveness, frequent and repeated spraying of anti-fog agents will cause considerable inconvenience to users and increase unnecessary costs.

In view of this, solving some or all of the above problems has become the research and development goal of the industry.

SUMMARY OF THE INVENTION

An objective of the present invention is to provide a water sports mask, in which a hard and lightweight non-glass layer is integrally injection-molded onto an inner surface (i.e., the surface proximal to the user) of the glass viewing window, thereby jointly forming a transparent viewing window module. Specifically, the transparent viewing window module includes a glass viewing window and an integrally-formed transparent encapsulation layer tightly attaching to the peripheral portion and the inner surface of the glass viewing window. This design provides the glass viewing window with both explosion-proof and anti-fog capabilities. Additionally, the mask can be customized for users with myopia or hyperopia while preserving a lightweight design.

To achieve the above objective, the present invention discloses a transparent viewing window module, which includes a glass viewing window and an integrally-formed transparent encapsulation layer. The glass viewing window has an inner surface, an outer surface opposite to the inner surface and a peripheral portion. The peripheral portion is defined along an outer contour of the glass viewing window. The integrally-formed transparent encapsulation layer fully and tightly encompasses the peripheral portion and the inner surface of the glass viewing window.

In an example, the glass viewing window has a thickness ranging between 0.3 and 4 mm, and the integrally-formed transparent encapsulation layer has a thickness ranging between 0.3 and 4 mm.

In one specific example, the thickness of the glass viewing window ranges between 2 and 4 mm, and the thickness of the transparent encapsulation layer ranges between 1.5 and 4 mm.

In an example, the integrally-formed transparent encapsulation layer is made of thermoplastic and has a Shore D hardness ranging between 40 and 90.

In an example, the thermoplastic is selected from polycarbonate (PC), polypropylene (PP), polyoxymethylene (POM), acrylic, acrylonitrile butadiene styrene (ABS), nylon, or any combinations thereof.

In an example, the integrally-formed transparent encapsulation layer is made of thermosetting silicone rubber and has a Shore A hardness ranging between 10 and 90.

In an example, the integrally-formed transparent encapsulation layer is composed of an anti-fog material, an anti-ultraviolet (UV) material, or a combination thereof.

In an example, wherein the integrally-formed transparent encapsulation layer has a functional portion tightly encompassing the inner surface of the glass viewing window, in which and the functional portion is a vision correction layer.

Furthermore, based on the same objective as above, the present invention discloses a mask, which includes an aforementioned transparent viewing window module and a waterproof skirt. The waterproof skirt has a front portion being embedded with the transparent viewing window module and a rear portion being configured to water-tightly fit a face of a user.

Additionally, based on the same objective as above, the present invention discloses a mask, which includes two aforementioned transparent viewing window modules, a frame portion and a waterproof skirt. The frame portion is configured for the two transparent viewing window modules being embedded therewith. The waterproof skirt has a front portion being embedded with the two transparent viewing window modules and the frame portion, and a rear portion being configured to water-tightly fit a face of a user.

DESCRIPTION OF THE PREFERRED EMBODIMENT

Figure 1A:
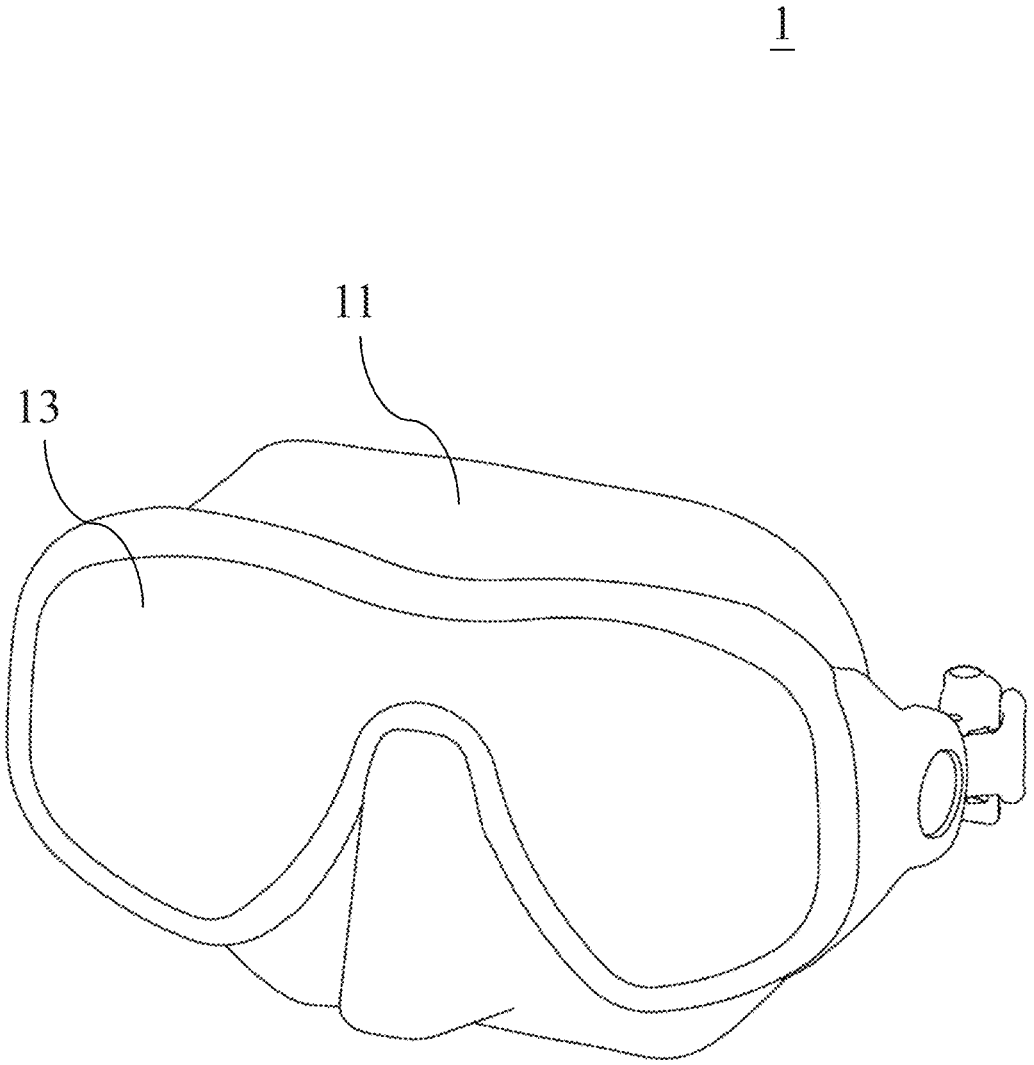
FIG. 1A (Prior art)
FIG. 1A is a schematic perspective view of a conventional single viewing window mask (in which a head strap is omitted for illustration).
Figure 1B:
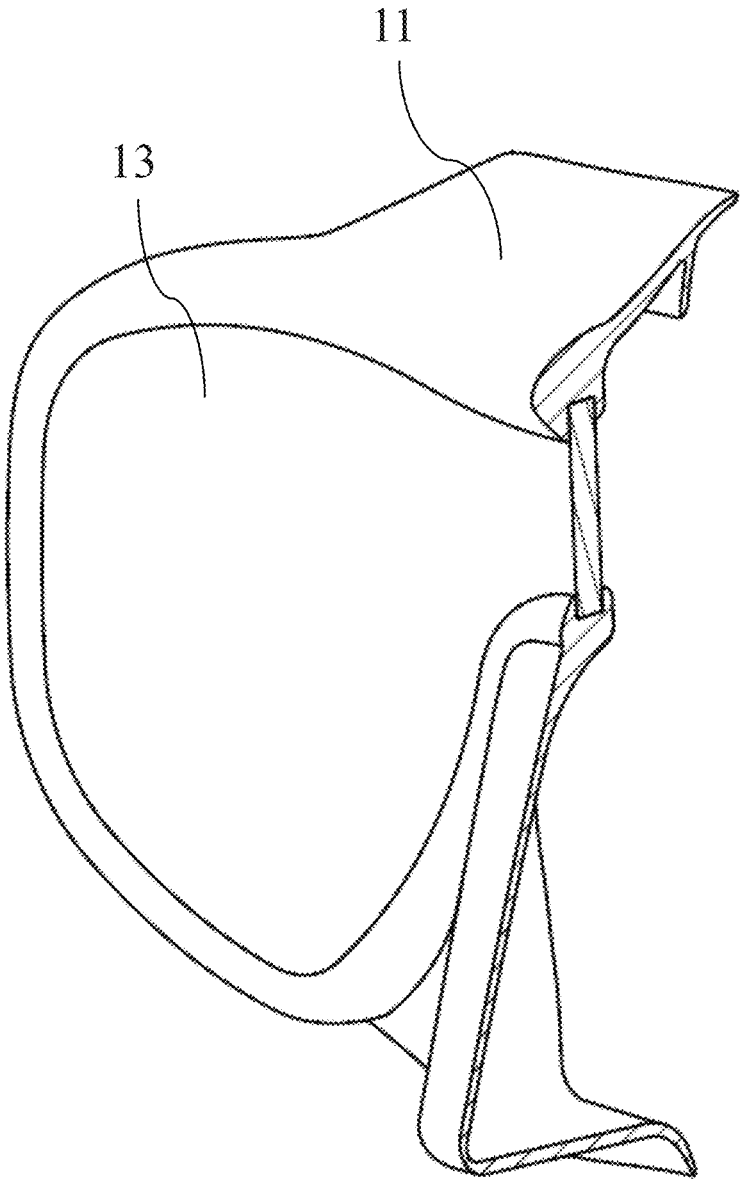
FIG. 1B (Prior art)
FIG. 1B is a schematic sagittal cross-sectional view of FIG. 1A.
Figure 1C:
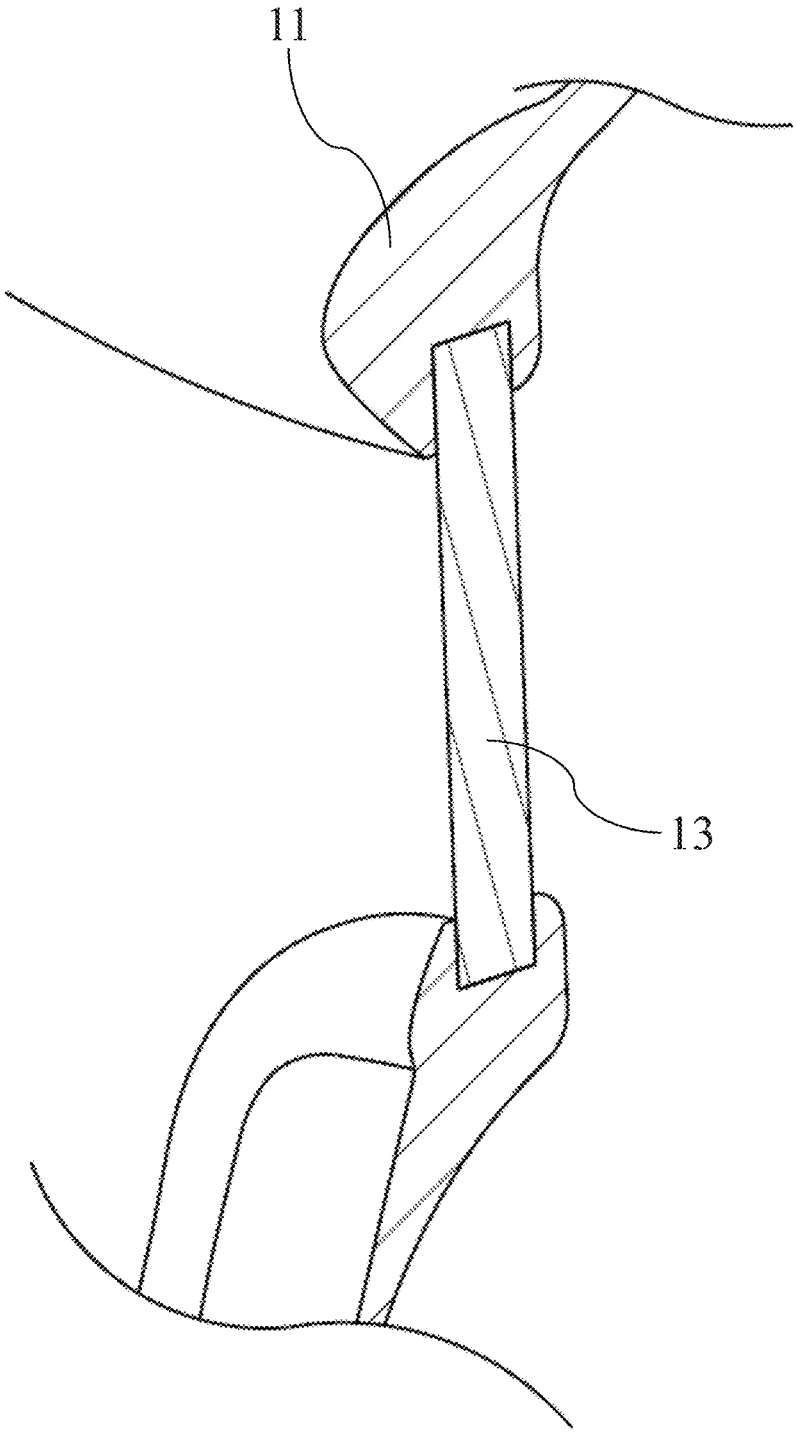
FIG. 1C (Prior art)
FIG. 1C is a schematic partially enlarged perspective view of FIG. 1B.
Figure 2A:
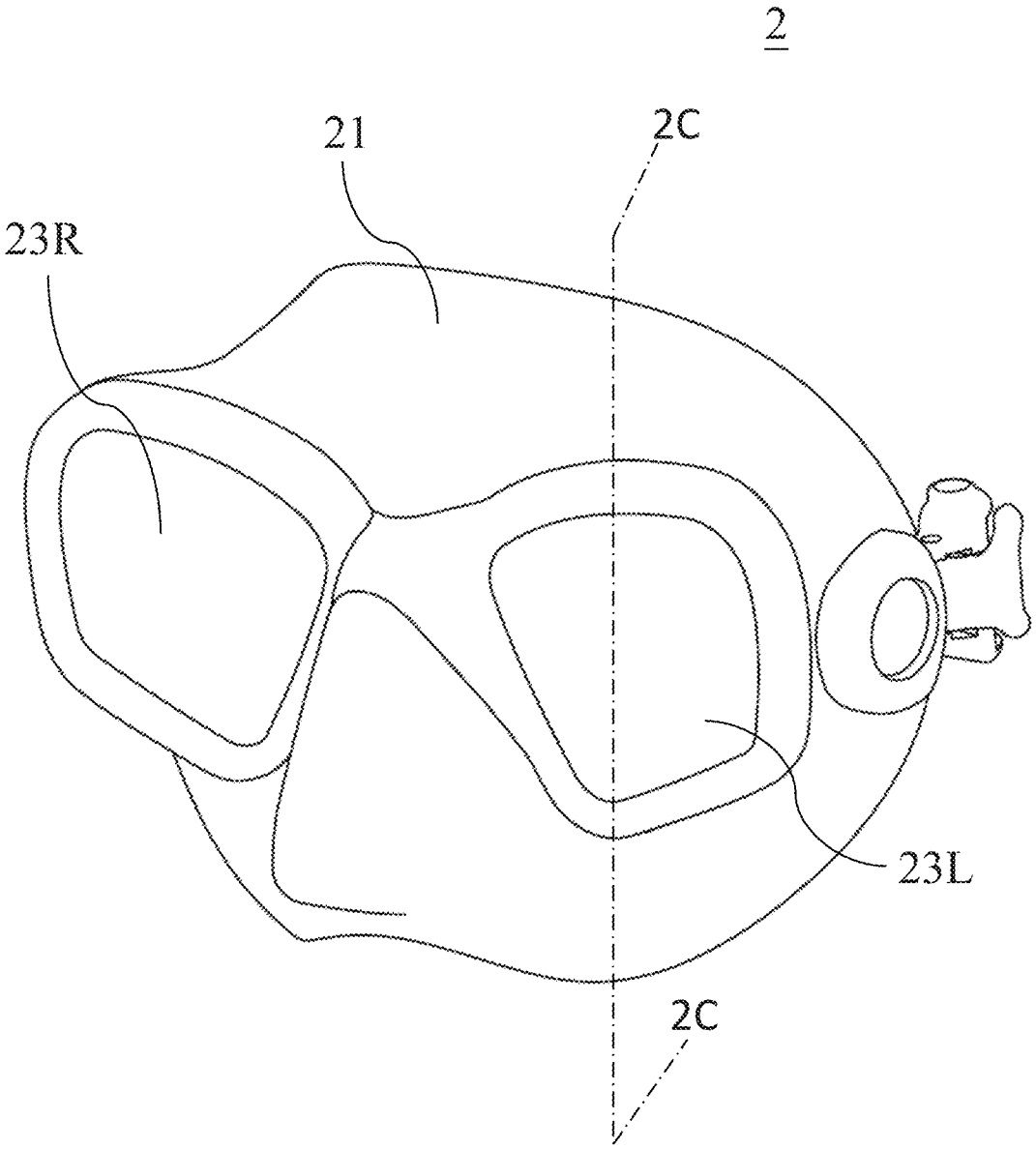
FIG. 2A (Prior art)
FIG. 2A is a schematic perspective view of a conventional dual-viewing windows mask (in which a head strap is omitted for illustration).
Figure 2B:
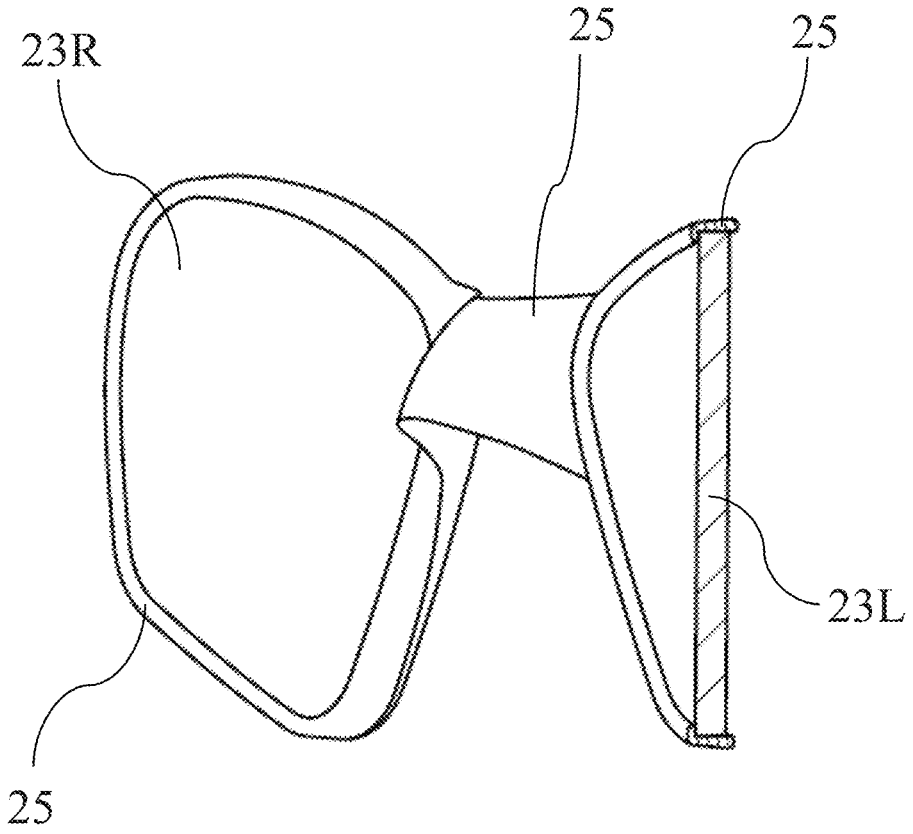
FIG. 2B (Prior art)
FIG. 2B shows a schematic cross-sectional view of the inner frame and glass viewing window in FIG. 2A.
Figure 2C:
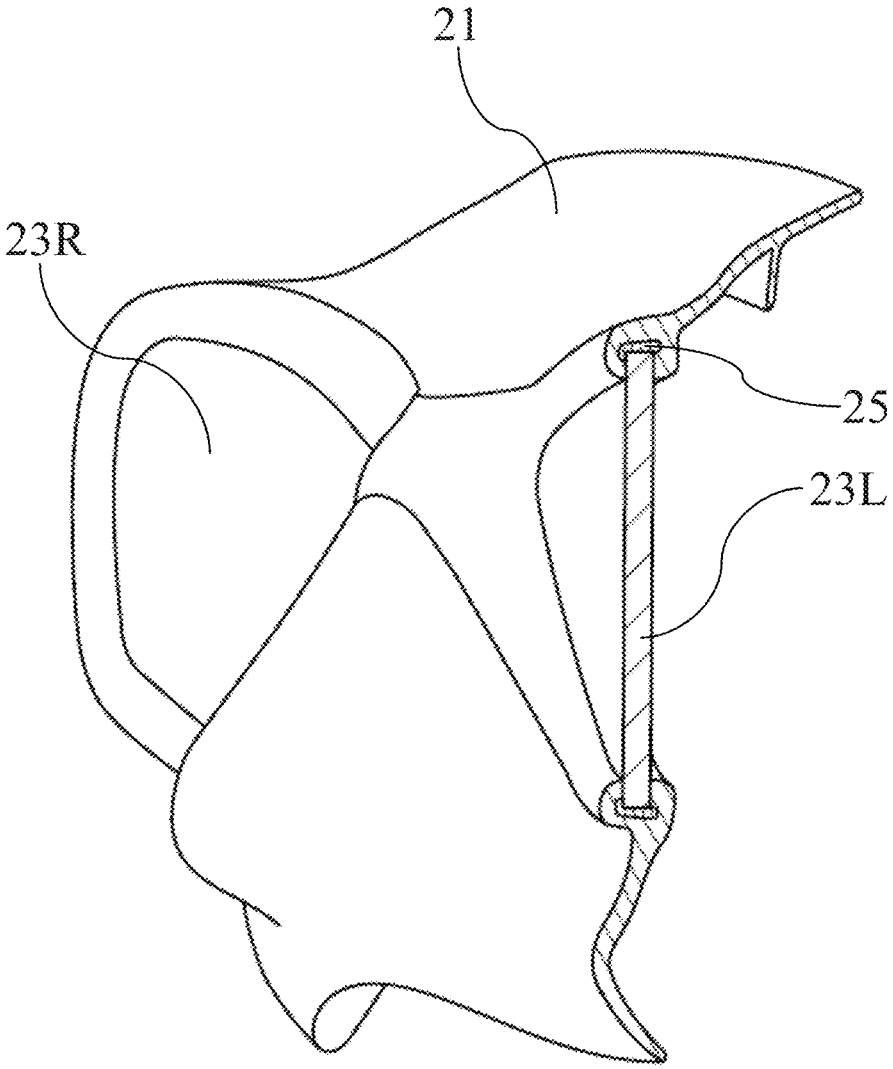
FIG. 2C (Prior art)
FIG. 2C is a schematic cross-sectional view along line 2C-2C of FIG. 2A.
Figure 2D:
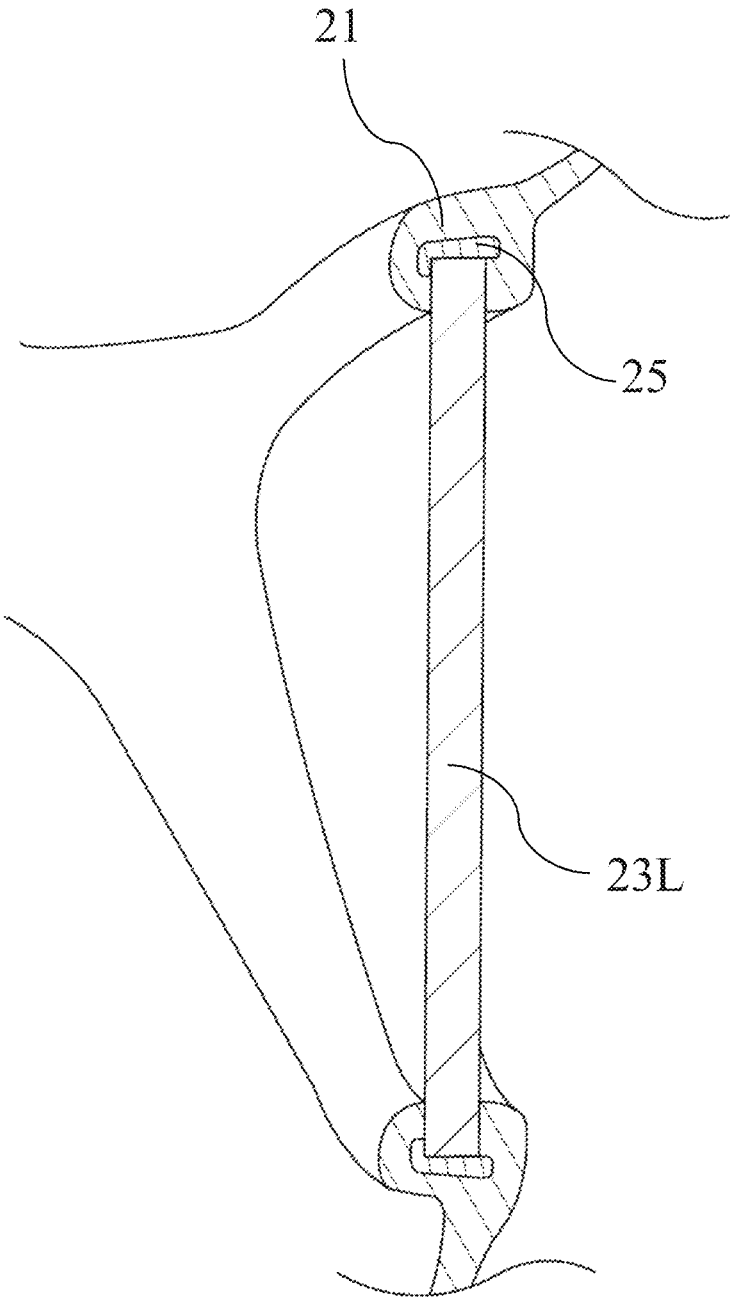
FIG. 2D (Prior art)
FIG. 2D is a schematic partially enlarged perspective view of FIG. 2C.

It shall be appreciated that the following description of the embodiments is only to explain the contents of the present invention, but not to limit the invention as claimed. Elements not directly related to the present invention are omitted from the description, and the dimensions as depicted for all elements in the drawings are just for easy understanding and do not intend to limit their actual scales. In addition, the used "front," "back," "left," "right," "inner," "outer," or the like adjectives defined in the descriptions are referred to by the direction of the user himself/herself. They are only relative relationships and are not limitative.

An embodiment of a mask 3 (e.g., a water sports mask) of the present invention is shown in FIGS. 3A and 3B and FIGS. 4A and 4B. In this embodiment, the mask 3 is exemplified by a dual-viewing windows mask.

Figure 3A:
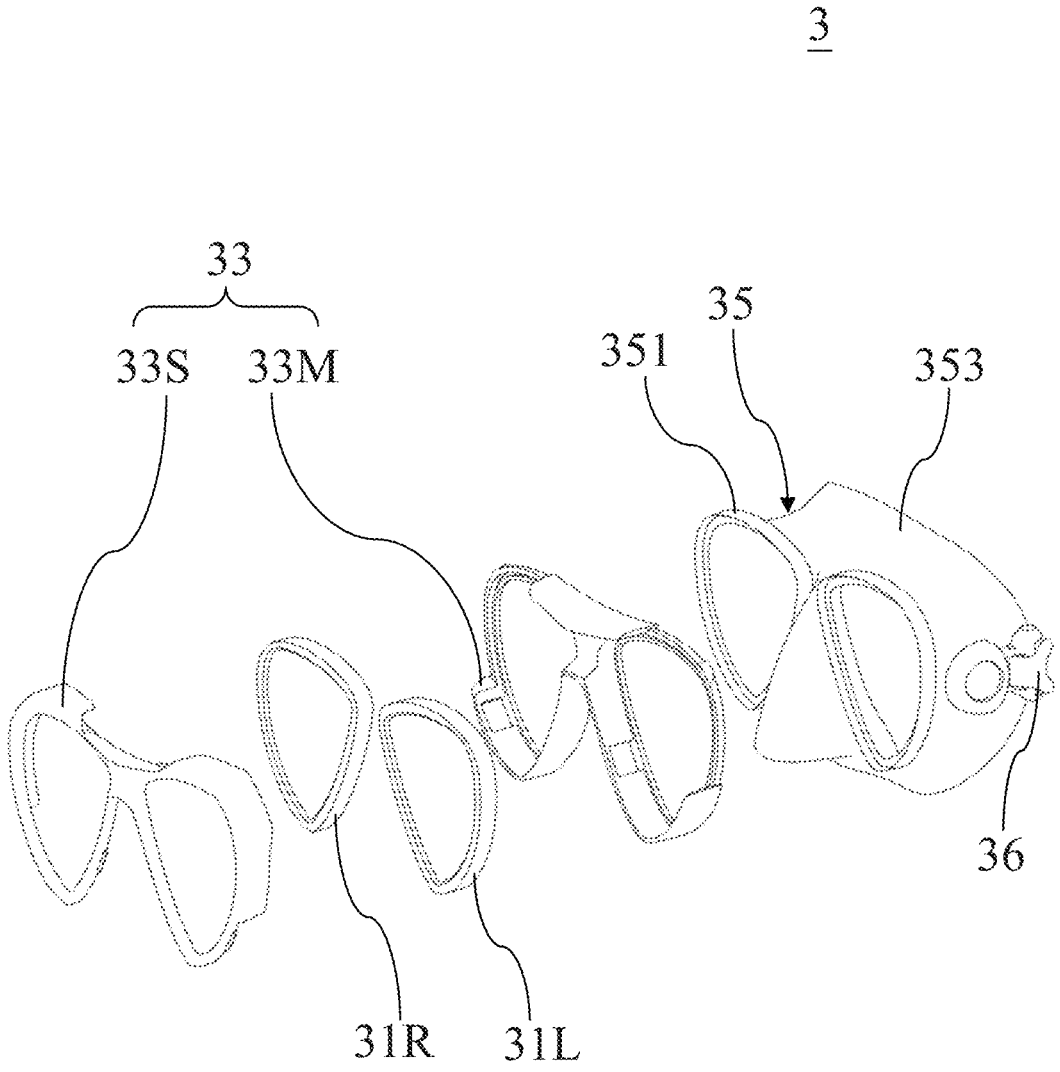
FIG. 3A is a schematic exploded view of the mask of the present invention (in which a head strap is omitted for illustration).
Figure 3B:
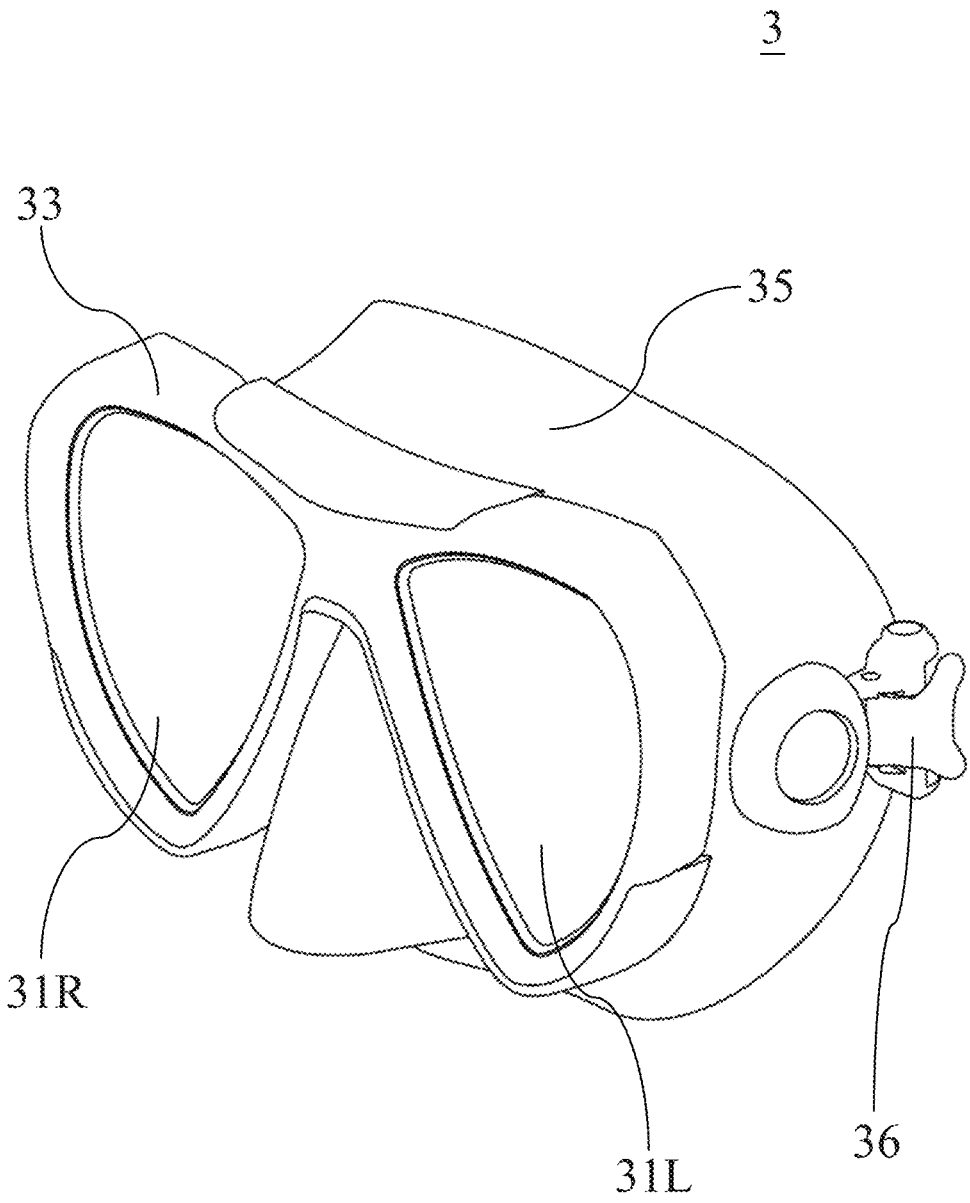
FIG. 3B is a schematic perspective view of the assembled mask of FIG. 3A.

Reference is made to FIG. 3A, in which the mask 3 includes two transparent viewing window modules 31L, 31R, a frame portion 33 and a waterproof skirt 35. Preferably, a fastener 36 is provided on both sides of the waterproof skirt 35 to allow a head strap (not shown) to be fastened to them, respectively. The frame portion 33 may include a main frame 33M and a sub-frame 33S. The waterproof skirt 35 has a front portion 351 being embedded with the transparent viewing window modules 31L, 31R and a rear portion 353 being configured to water-tightly fit a face of a user.

The frame portion 33 may be made of a rigid material. The rigid material is selected from polycarbonate (PC), polyoxymethylene (POM), acrylonitrile butadiene styrene copolymer (ABS), polyvinylchloride (PVC), polyethylene (PE), polypropylene (PP) or combinations thereof. The waterproof skirt 35 may be made of silicone rubber material.

To assemble the mask 3, the front portion 351 of the waterproof skirt 35 can be embedded with the main frame 33M first, and the transparent viewing window modules 31L and 31R can then be installed from the front to the back into the main frame 33M, and then the sub-frame 33S can be joined with the main frame 33M from the front to the back. At this time, as exemplarily illustrated in FIG. 3B, the front portion 351 of the waterproof skirt 35 is water-tightly embedded with the main frame 33M and the transparent viewing window module 31L.

Figure 4A:
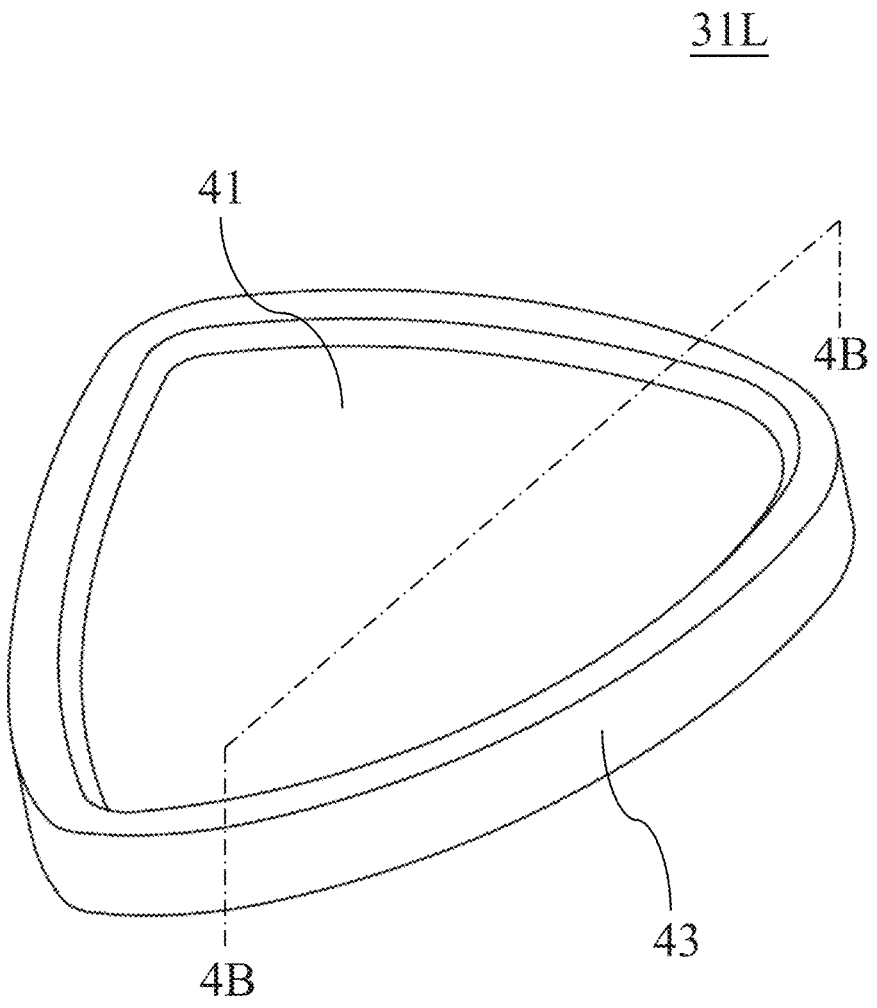
FIG. 4A is a schematic perspective view of one of the transparent viewing window modules in FIG. 3A.
Figure 4B:
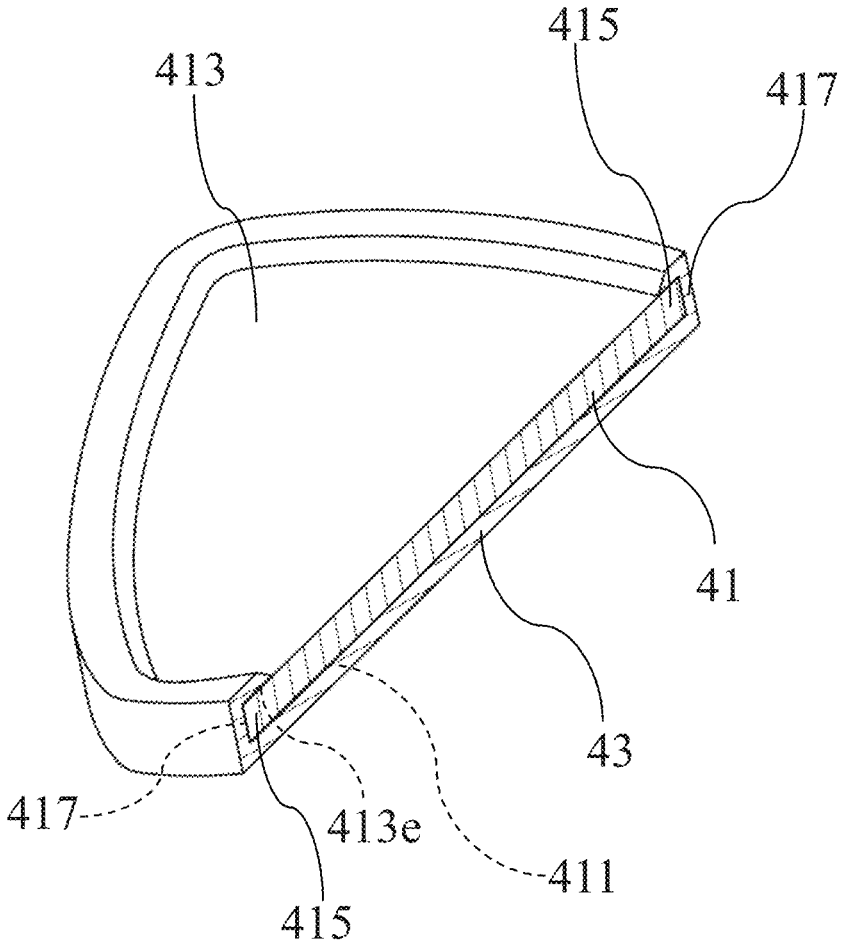
FIG. 4B is a schematic cross-sectional view along line 4B-4B of FIG. 4A.

The transparent viewing window module 31L is shown in FIGS. 4A and 4B. Since the transparent viewing window module 31R and the transparent viewing window module 31L have the same composition and may only differ in shape as mirror images due to their left and right configuration, the following description will use the transparent viewing window module 31L as an example for illustration. However, in fact, it should be understood that depending on the appearance design of the mask, the transparent viewing window modules 31R and 31L may be different in shape or be completely identical. Both designs are applicable to the present invention as long as they have substantially the same composition.

The transparent viewing window module 31L includes a glass viewing window 41 and an integrally-formed transparent encapsulation layer 43. The glass viewing window 41 may be made of a tempered glass. The glass viewing window 41 includes an inner surface 411, an outer surface 413 opposite to the inner surface 411 and a peripheral portion 415. The integrally-formed transparent encapsulation layer 43 fully and tightly encompasses the peripheral portion 415 and the inner surface 411 (i.e., the surface proximal to the user's eyes) of the glass viewing window 41. Preferably, the integrally-formed transparent encapsulation layer 43 is directly integrally formed on the peripheral portion 415 and the inner surface 411 of the glass viewing window 41 through an injection-molding process. The peripheral portion 415 is defined by an outer contour of the glass viewing window 41, and it may only include one side surface 417 of the glass viewing window 41. Alternatively, it may also include an outer edge 413*e* of the outer surface 413.

Instead of directly injecting a transparent encapsulation layer 43 to encapsulate an already formed glass viewing window 41, in another embodiment, a glass viewing window can first be formed through a glass injection-molding process using either the same or a different machine. Subsequently, a transparent encapsulation layer 43 is integrally injection-molded onto the peripheral portion 415 and the inner surface 411 of the glass viewing window 41 through an injection-molding process, thereby directly constructing the transparent viewing window module 31L.

The integrally-formed transparent encapsulation layer 43 may be made of thermoplastic and has a Shore D hardness ranging between 40 and 90. Alternatively, it may be made of thermosetting silicone rubber and has a Shore A hardness between 10 and 90. However, it is not limited to these materials, and any transparent, lightweight, non-glass materials are feasible. For example, the thermoplastic may be selected from polycarbonate (PC), polypropylene (PP), polyoxymethylene (POM), acrylic, acrylonitrile butadiene styrene (ABS), nylon or combinations thereof. Herein, the transparent non-glass material refers to a material that does not impede the user's view and may be tinted or colorless.

In the embodiment of the transparent viewing window module 31L without vision correction function (i.e., plano), the glass viewing window 41 has a thickness ranging between 0.3 and 4 mm, and the integrally-formed transparent encapsulation layer 43 has a thickness ranging between 0.3 and 4 mm. Preferably, the thickness of the glass viewing window 41 ranges between 2 and 4 mm, and the thickness of the integrally-formed transparent encapsulation layer 43 ranges between 1.5 and 4 mm. When the transparent viewing window module 31L is provided with a vision correction function, the present invention requires only modifying the shape and thickness of the integrally-formed transparent encapsulation layer 43, particularly the thickness and curvature of the portion (which can be referred to as the functional portion) attaching to the inner surface 411 of the glass viewing window 41. Consequently, the integrally-formed transparent encapsulation layer 43 can provide diopter correction for the user's eyes without altering the glass viewing window 41, thereby achieving the objective of lightweight design. In other words, the integrally-formed transparent encapsulation layer 43 may have a functional portion tightly encompassing the inner surface 411 of the glass viewing window 41, which serves as a vision correction layer.

In addition, since the integrally-formed transparent encapsulation layer 43 of the present invention not only encapsulates the peripheral portion of the glass viewing window 41 but also its inner surface 411 (i.e., it is in contact with and flat against the inner side of the glass viewing window 41). Therefore, it can effectively prevent glass fragments from being flown toward the user in the event of the glass viewing window 41 breaking so as to provide effective protection for the user, particularly for the user's eyes. In addition, the integrally-formed transparent encapsulation layer 43 may be made of materials with inherent anti-fog or UV-resistant properties, providing anti-fog or UV-resistant functions to further enhance the added value of the mask 3. In practice, even if the integrally-formed transparent encapsulation layer 43 does not provide anti-fog or UV-resistant properties, the material of the integrally-formed transparent encapsulation layer 43 (e.g., PC) is easier to be coated with an anti-fog layer or other functional layers than the glass material. Therefore, the integrally-formed transparent encapsulation layer 43 can provide more added benefits to the mask 3 in practical applications.

The above embodiment mainly takes the mask 3 as a dual-viewing windows mask for illustration. However, based on the detailed description above, it can be understood that the single-viewing window mask of the present invention can simply include a transparent viewing window module and a waterproof skirt. The assembly of the single-viewing window mask may be achieved by directly injection-molding the waterproof skirt onto the transparent viewing window module (i.e., the front portion of the waterproof skirt is embedded with the transparent viewing window module), thereby providing considerable strength of product. However, in practice, adding a frame portion to enhance the overall strength of the mask is also feasible.

Figure 5:
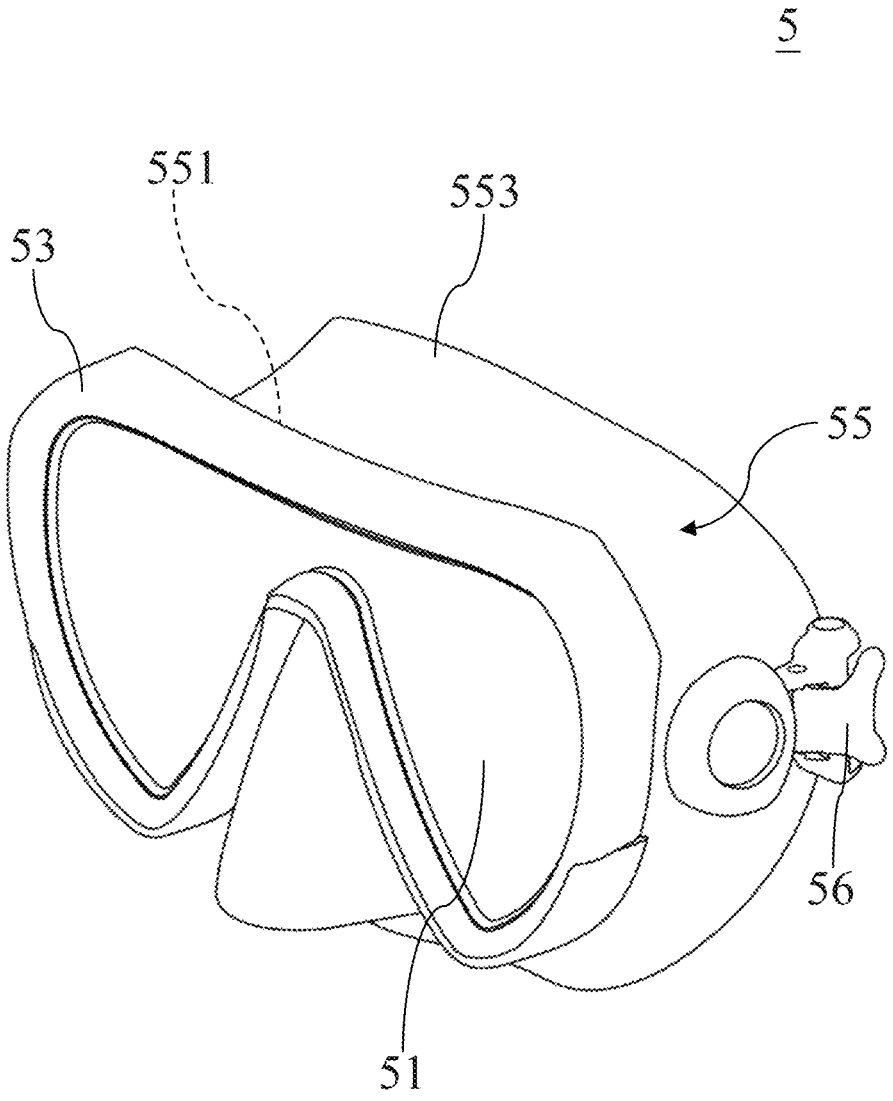
FIG. 5 is a schematic perspective view of the single-viewing window mask of the present invention (in which a head strap is omitted for illustration).

For example, as shown in FIG. 5, the single-viewing window mask 5 includes a transparent viewing window module 51, a frame portion 53 (optional) and a waterproof skirt 55. Likewise, a fastener 56 is preferably provided on both sides of the waterproof skirt 55 to allow a head strap (not shown) to be fastened to them, respectively. The waterproof skirt 55 has a front portion 551 being embedded with the transparent viewing window module 51 and a rear portion 553 being configured to water-tightly fit the face of a user. Since the transparent viewing window module 51 has the same composition as the transparent viewing window modules 31L, 31R and may only differ in shape and size, it will not be further described herein.

It shall be appreciated that in the drawings, elements not directly related to the present invention, or elements (such as the head strap that ties up the user's head) which may influence the comprehension, are omitted from the illustration. And, the dimensional proportions among individual elements in the drawings are provided only for one of the aspects but not to limit the present invention.

Among various masks for scuba diving or snorkeling, those that only cover the user's eyes and nose, most often use glass as the material of the viewing window. Therefore, the mask of the present invention is designed to encapsulate the glass viewing window with a non-glass material (e.g., plastic) instead of just using the conventional single glass viewing window. This not only effectively prevents injuries caused by accidental breakage of the glass viewing window but also provides vision correction, anti-fog, and UV-resistant functions without significantly increasing the overall weight of the mask, thereby maximizing its effectiveness.

Any modifications based on the above core technology of the present invention are intended to be protected. Consequently, the above embodiments are used only to illustrate the implementations of the present invention and to explain the technical features of the present invention and are not used to limit the scope of the present invention. Any modifications or equivalent arrangements that can be easily accomplished by those skilled in the art are considered to fall within the scope of the present invention, and the scope of the present invention should be limited by the claims of the patent application.

What is claimed is:

1. A transparent viewing window module, comprising:

a glass viewing window having:

an inner surface;

an outer surface opposite to the inner surface; and a peripheral portion defined along an outer contour of the glass viewing window; and an integrally-formed transparent encapsulation layer, fully and tightly encompassing the peripheral portion and the inner surface of the glass viewing window;

wherein the glass viewing window has a thickness ranging between 0.3 and 4 mm, and the integrally-formed transparent encapsulation layer has a thickness ranging between 0.3 and 4 mm; and wherein the integrally-formed transparent encapsulation layer is made of thermoplastic and has a Shore D hardness ranging between 40 and 90.

2. The transparent viewing window module of claim 1, wherein the thickness of the glass viewing window ranges between 2 and 4 mm, and the thickness of the integrally-formed transparent encapsulation layer ranges between 1.5 and 4 mm.

3. The transparent viewing window module of claim 1, wherein the thermoplastic is selected from polycarbonate (PC), polypropylene (PP), polyoxymethylene (POM), acrylic, acrylonitrile butadiene styrene (ABS), nylon, or any combinations thereof.

4. The transparent viewing window module of claim 1, wherein the integrally-formed transparent encapsulation layer has a functional portion tightly encompassing the inner surface of the glass viewing window, in which the functional portion is a vision correction layer.

5. A transparent viewing window module, comprising:
a glass viewing window having:
an inner surface;
an outer surface opposite to the inner surface; and
a peripheral portion defined along an outer contour of the glass viewing window; and
an integrally-formed transparent encapsulation layer, fully and tightly encompassing the peripheral portion and the inner surface of the glass viewing window;
wherein the glass viewing window has a thickness ranging between 0.3 and 4 mm, and the integrally-formed transparent encapsulation layer has a thickness ranging between 0.3 and 4 mm; and
wherein the integrally-formed transparent encapsulation layer is made of thermosetting silicone rubber and has a Shore A hardness ranging between 10 and 90.

6. The transparent viewing window module of claim 5, wherein the glass viewing window has a thickness ranging between 0.3 and 4 mm, and the integrally-formed transparent encapsulation layer has a thickness ranging between 0.3 and 4 mm.

7. The transparent viewing window module of claim 6, wherein the thickness of the glass viewing window ranges between 2 and 4 mm, and the thickness of the integrally-formed transparent encapsulation layer ranges between 1.5 and 4 mm.

8. A mask, comprising:
a transparent viewing window module, comprising:
a glass viewing window having:
an inner surface;
an outer surface opposite to the inner surface; and
a peripheral portion defined along an outer contour of the glass viewing window; and
an integrally-formed transparent encapsulation layer, fully and tightly encompassing the peripheral portion and the inner surface of the glass viewing window; and
a waterproof skirt having a front portion being embedded with the transparent viewing window module and a rear portion being configured to water-tightly fit a face of a user.

9. The mask of claim 8, wherein the glass viewing window has a thickness ranging between 0.3 and 4 mm, and the integrally-formed transparent encapsulation layer has a thickness ranging between 0.3 and 4 mm.

10. The mask of claim 9, wherein the thickness of the glass viewing window ranges between 2 and 4 mm, and the thickness of the integrally-formed transparent encapsulation layer ranges between 1.5 and 4 mm.

11. The mask of claim 9, wherein the integrally-formed transparent encapsulation layer is made of thermoplastic with a Shore D hardness ranging between 40 and 90 or thermosetting silicone rubber with a Shore A hardness ranging between 10 and 90.

12. The mask of claim 9, wherein the integrally-formed transparent encapsulation layer is composed of an anti-fog material, an anti-ultraviolet (UV) material, or a combination thereof.

13. The mask of claim 9, wherein the integrally-formed transparent encapsulation layer has a functional portion tightly encompassing the inner surface of the glass viewing window, in which the functional portion is a vision correction layer.

14. A mask, comprising:
two transparent viewing window modules, each of the two transparent viewing window modules comprising:
a glass viewing window having:
an inner surface,
an outer surface opposite to the inner surface; and
a peripheral portion defined along an outer contour of the glass viewing window; and
an integrally formed transparent encapsulation layer, fully and tightly encompassing the peripheral portion and the inner surface of the glass viewing window,
a frame portion for the two transparent viewing window modules being embedded therewith; and
a waterproof skirt having a front portion being embedded with the two transparent viewing window modules and the frame portion, and a rear portion being configured to water-tightly fit a face of a user.

15. The mask of claim 14, wherein the glass viewing window has a thickness ranging between 0.3 and 4 mm, and the integrally-formed transparent encapsulation layer has a thickness ranging between 0.3 and 4 mm.

16. The mask of claim 15, wherein the thickness of the glass viewing window ranges between 2 and 4 mm, and the thickness of the integrally-formed transparent encapsulation layer ranges between 1.5 and 4 mm.

17. The mask of claim 15, wherein the integrally-formed transparent encapsulation layer is made of thermoplastic with a Shore D hardness ranging between 40 and 90 or thermosetting silicone rubber with a Shore A hardness ranging between 10 and 90.

18. The mask of claim 15, wherein the integrally-formed transparent encapsulation layer is composed of an anti-fog material, an anti-ultraviolet (UV) material, or a combination thereof.

19. The mask of claim 14, wherein the integrally-formed transparent encapsulation layer has a functional portion tightly encompassing the inner surface of the glass viewing window, in which the functional portion is a vision correction layer.

* * * * *